US005315934A

United States Patent [19]

List, deceased et al.

[11] Patent Number: 5,315,934

[45] Date of Patent: May 31, 1994

[54] CONSTANT CONTACT SIDE BEARINGS WITH SPRING BIASED SLIDING WEDGES

[75] Inventors: Harold A. List, deceased, late of Baltimore, Md.; by Marie F. List, executrix, Yardley, Pa.

[73] Assignee: Railway Engineering Associates, Inc., Baltimore, Md.

[21] Appl. No.: 998,394

[22] Filed: Dec. 30, 1992

[51] Int. Cl.[5] ..... B61F 5/14

[52] U.S. Cl. ..... 105/199.3

[58] Field of Search ..... 384/423; 105/199.3

[56] References Cited

U.S. PATENT DOCUMENTS

| | | | |
|---|---|---|---|
| 1,037,511 | 9/1912 | Norell | 384/423 |
| 3,401,991 | 9/1968 | MacDonnell | 105/199.3 X |
| 3,533,359 | 10/1970 | Williams | 105/199.3 |
| 3,713,398 | 1/1973 | Zupez | 105/199.3 |
| 3,981,548 | 9/1976 | MacDonnell et al. | 105/199.3 X |
| 4,781,124 | 11/1988 | List | 105/168 |
| 5,138,954 | 8/1992 | Mulcahy | 105/199.3 |

FOREIGN PATENT DOCUMENTS

| | | | |
|---|---|---|---|
| 489311 | 12/1952 | Canada | 384/423 |
| 373198 | 3/1973 | U.S.S.R. | 105/199.3 |

*Primary Examiner*—Robert J. Oberleitner
*Assistant Examiner*—S. Joseph Morano
*Attorney, Agent, or Firm*—Synnestvedt & Lechner

[57] ABSTRACT

Constant contact side bearing support of a rail car body on a multi-axle rail car truck is provided for the purpose of restraining truck hunting and controlling car rocking. A bearing receiver or cage mounted on the truck bolster in laterally offset relationship to the truck center plate bowl supports wedge shaped bearing blocks on inclined surfaces within the cage. Biasing means, e.g., a long travel coil spring, biases the bearing blocks against the inclined surfaces of the cage, thereby maintaining a substantially constant normal bearing force on the car body throughout the wear life of the bearings. In an alterative embodiment, the cage is mounted on the car body with the bearing surfaces of the bearing blocks engaging corresponding bearing surfaces on the bolster. Arrangements providing for ease of inspection and replacement of the bearing blocks are disclosed.

18 Claims, 3 Drawing Sheets

CONSTANT CONTACT SIDE BEARINGS WITH SPRING BIASED SLIDING WEDGES

FIELD OF THE INVENTION

This invention relates to vehicle trucks, each comprising a plurality of axle mounted wheel sets, and particularly to railway trucks. The invention involves the provision of side bearings for support of a car body on the truck in spaced positions laterally of the truck center point.

BACKGROUND OF THE INVENTION

So called "constant contact side bearings" have been provided for many years as a means of suppression of truck hunting by increasing resistance to truck bolster swivel. Although known devices work when initially installed, the effective life is relatively short. The need for frequent adjustment and replacement has limited the gains achieved through their use. Further, improvements in the control of car rocking through the use of side bearings have been generally quite limited because the existing devices commonly in use do not dissipate energy in the vertical direction. Where elastomeric springs are used for this purpose, any improvement achieved is short lived as these springs do not maintain their vertical stiffness on a long-term basis. This is due to the temperature rise associated with the constant rubbing which causes deterioration of the elastomeric material. In efforts to compensate for this problem, the initial vertical load carried by the side bearings is made relatively large but this tends to create a derailment hazard when the side bearings are used under empty cars. Side bearings exemplary of the known prior art are disclosed in my U.S. Pat. Nos. 4,131,069 and 4,655,143 and in U.S Pat. No. 5,048,427.

SUMMARY OF THE INVENTION

Through the use of steering trucks of the kind disclosed in my U.S. Pat. No. 4,655,143, dramatic increases in freight rail car speeds have become practical in recent years to such an extent that other factors, such as car body rocking and consequent damage to cargo, have become primary limitations to high speed operation. The present invention fulfills a significant need by the effective elimination of car body rocking not only in cars equipped with conventional trucks, but especially in high center of gravity cars equipped with self-steering trucks and employed in high speed operation. The potential for high speeds without cargo damage is more effectively achieved.

In summary, the invention involves the provision of spring-loaded wedge shaped bearing blocks which are mounted in receivers or cages, preferably on the truck bolster, on some other vertically facing truck surface laterally offset from the truck center plate bowl or on the car body bolster or in pairs on facing surfaces on the truck and the car body. The receivers or cages have forwardly and rearwardly inclined end wall surfaces on which the bearing blocks are supported with an inclined support surface on each block interfacing with one of the inclined surfaces of the cage. Biasing means, preferably comprising a long travel steel coil spring, interact with the pair of bearing blocks to yieldably maintain contact between the interfacing inclined surfaces A bearing surface comprising the uppermost surface of each wedge shaped block bears against a cooperating surface on the under side of the car body with a substantially constant force at all times independent of bearing surface wear. The wedge shaped bearing blocks, being biased by the long travel steel springs, provide substantial damping of both vertical motion as well as longitudinal motion. The use of a large travel coil spring assures that the side bearing force is substantially constant throughout the wear life of the bearing blocks.

Preferably, the assembly is held together by a pair of pins, allowing for ready replacement of worn bearing blocks. According to one embodiment of the invention, the assembly is mounted on the car body rather than the bolster, placing the cage with the opening facing downwardly so that dust and dirt do not accumulate in it. In this case, the bearing surfaces on the bearing blocks bear against cooperating bearing surfaces on the truck at locations outboard from the truck center point.

It is also within the scope of the invention to provide the side bearing assemblies in pairs with one bearing assembly of a pair being on the truck bolster and the other on the car body with the upper and lower surfaces of the blocks being in engagement with one another.

With the foregoing in view, an important objective of the invention is the provision of a constant contact side bearing in a railway truck for the suppression of truck hunting.

A further objective of the invention is the provision of a constant contact side bearing including improved biasing means for maintaining bearing contact under constant pressure throughout a long, effective bearing life.

A still further objective of the invention is the use of a constant contact side bearing which offers improved suppression of car rocking.

A further objective of the invention is the provision of a side bearing assembly in which the wearing elements are easily replaced.

Another objective of the invention is the provision of a bearing assembly which facilitates mounting in a manner which avoids the accumulation of dust and dirt during use.

Other objects and advantages of the invention will become apparent from the following detailed description of a preferred embodiment of the invention.

DETAILED DESCRIPTION OF THE DRAWINGS

DETAILED DESCRIPTION OF THE PREFERRED EMBODIMENT OF THE INVENTION

Figure 1:
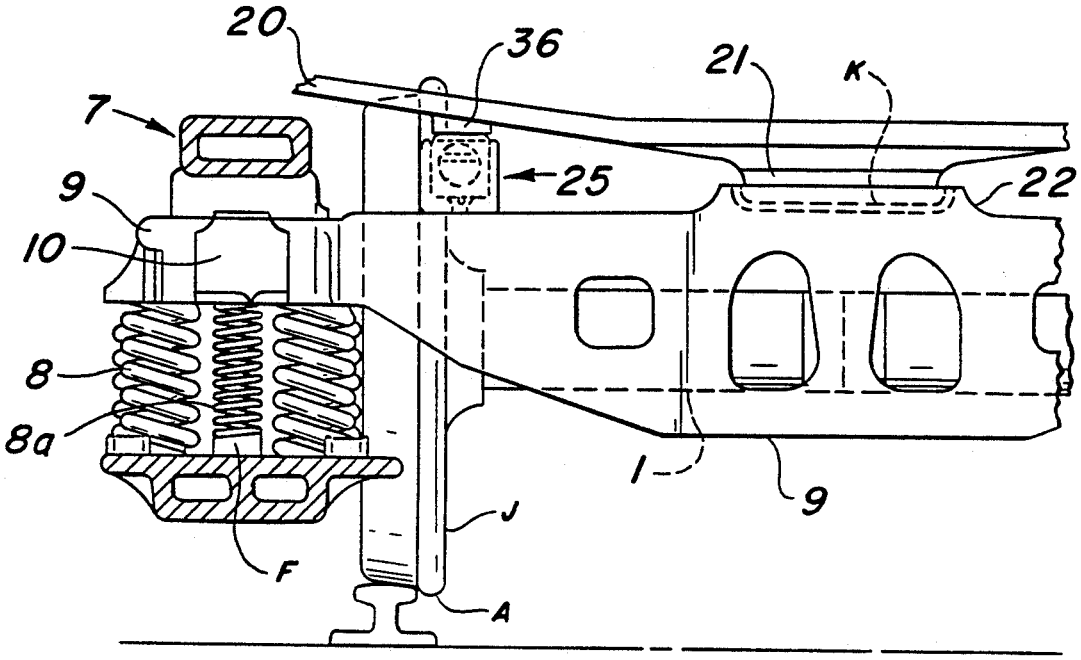
FIG. 1 is a fragmentary sectional view illustrating a conventional AAR railway truck equipped with the present invention.

A conventional three-piece freight car truck is shown in FIG. 1 for the purposes of illustration, it being understood that the invention has applicability for use in other types of freight and passenger rail car trucks having a plurality of wheel sets, including those illustrated in my U.S. Pat. No. 4,655,143. The truck, partially shown in FIG. 1, has rotating axles 1 with pressed-on wheels 3 having conventional tread profiles which provide a larger than average rolling radius when the wheel/rail contact is near wheel flange A and smaller rolling radius when the contact point is away from the flange.

The truck is provided with a pair of side frames, one of which is shown in section and identified by the reference character 7 in FIG. 1. Springs 8 and 8*a* are located in each of the side frames in the region generally indicated at F and support a truck bolster 9 which extends laterally of the truck between the axles 1 and yieldably interconnects the side frames. The axle ends are mounted in the frames through use of roller bearings, not shown.

The car body, represented at 20, typically includes a car center plate 21 which is supported within a center plate bowl 22 located centrally of truck bolster 9.

Figure 4:
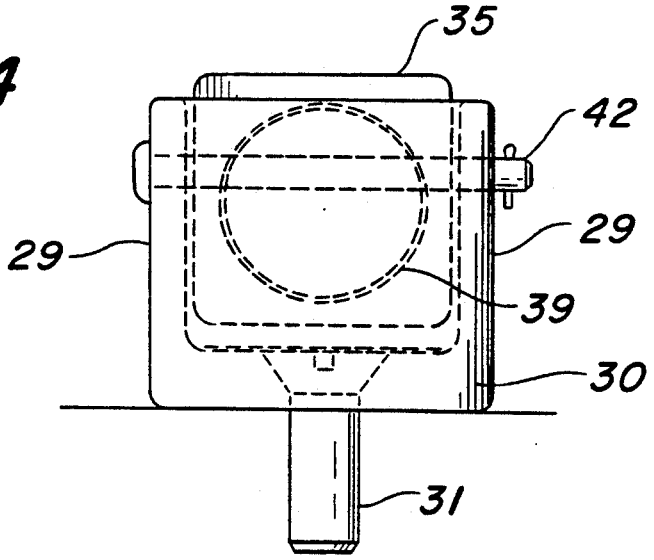
FIG. 4 is an end view of the bearing assembly of FIGS. 2 and 3.
Figure 2:
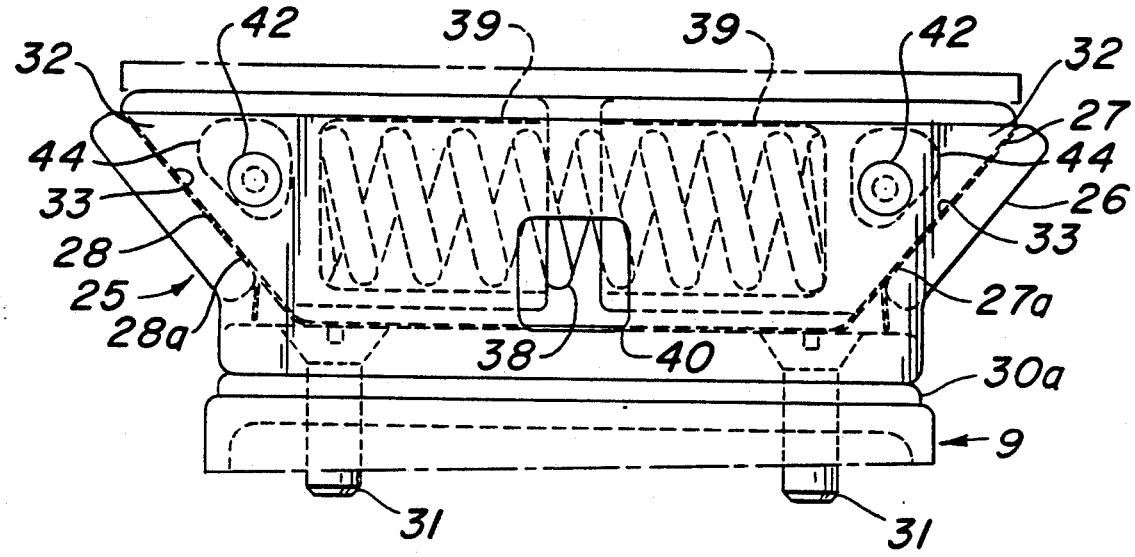
FIG. 2 is a view on an enlarged scale with respect to FIG. 1 illustrating a bearing assembly incorporating the principles of the invention.
Figure 3:
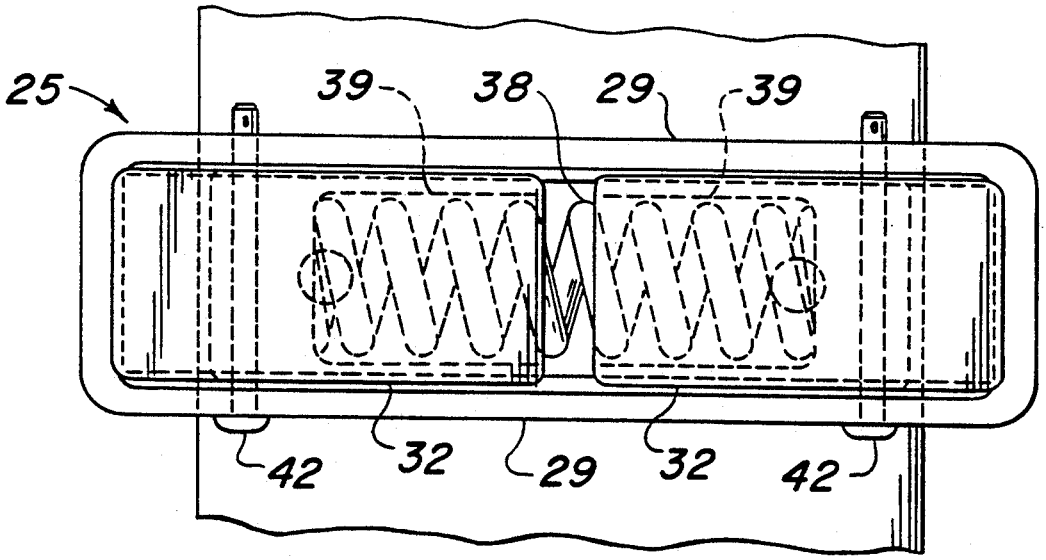
FIG. 3 is a plan view of the bearing assembly illustrated in FIG. 2.

It is recognized practice to mount side bearings on the bolster at points offset from the center plate bowl in efforts to control roll motion of the car body and to control truck hunting. In FIG. 1, an improved side bearing assembly is shown at 25. Bearing assembly 25 is shown in detail in FIGS. 2 through 4. In accordance with the preferred form of the invention, the bearing assembly 25 comprises a cage 26 having inclined wall surfaces 27 and 28, side walls 29 and a base 30. Surfaces 27 and 28 may be covered with hardened wear liners 27*a* and 28*a* formed of hardened steel or other suitable material, as will be understood by those of ordinary skill in the art. The base 30 is provided with counter sunk openings through which bolts 31 extend for the purpose of bolting the cage to truck bolster 9. As illustrated in FIG. 2, the cage is supported with the inclined surfaces extended transversely of the truck bolster (longitudinally of the car body) and inclining generally upwardly from the bolster surface. A relatively stiff pad of elastomeric material may be bonded to the under surface of base 30, as indicated at 30*a*.

In the preferred embodiment of the invention, the cage receives a pair of bearing blocks 32. Each bearing block has an inclined surface 33 which is complementary to the inclined surfaces 27 and 28 and is adapted to interface with one of these surfaces. The bearing blocks further include a bearing surface portion 35 which bears against a car body side bearing member 36 affixed to the car body, as is shown in FIG. 1.

According to the invention, biasing means, preferably comprising a long travel steel coil spring 38, fits within aligned longitudinally extending cylindrical guide cavities 39 in the bearing blocks 32 and biases the bearing blocks against the inclined surfaces 27 and 28. Spring 38 may be a conventional freight truck spring of the type utilized between the bolster and the truck framing in FIG. 1. By the use of the expression "long travel", it is to be understood that the spring will exert a substantially constant force throughout substantial range of deflection. In accordance with the invention, a spring is selected which will maintain the bearing surfaces of the bearing blocks in contact with the car body side bearings with a substantially constant force throughout the wear life of the bearings As can be best seen in FIG. 2, a clearance space exists between the underside of the bearing blocks and the upper surface of the base, the sole vertical support for the biased bearing blocks being provided by the inclined surfaces 27 and 28.

Preferably, an inspection hole 40 is provided in the cage side members to allow for inspection of the amount of separation between the bearing blocks. Keeper pins 42 are provided for the purpose of retaining the bearing blocks within the cage. Pins 42 extend through enlarged openings 44 extending through the sides of the bearing blocks, the openings 44 preferably being generally triangularly shaped so as to allow for both horizontal and vertical movement of the bearing blocks as the bearing surfaces of bearing members 36 wear. Cotter pins, not illustrated, may be utilized for the purpose of maintaining the keeper pins in position. Removal of the keeper pins allows for ready removal and replacement of the bearing blocks when the bearing surfaces wear out.

Figure 5:
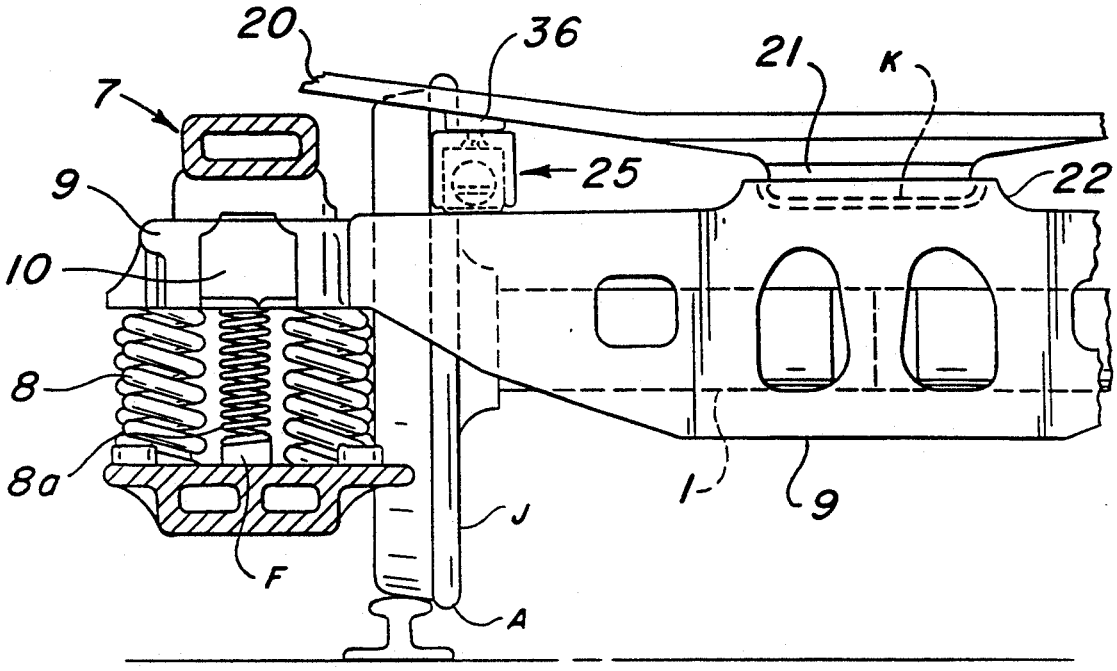
FIG. 5 is a view similar to FIG. 1 illustrating an alternative orientation of the bearing assembly, as compared to FIG. 1.

Although the assembly is mounted on the truck bolster in FIGS. 1 through 4, it is contemplated that the cage may be mounted on the car body with the opening facing downwardly and the bearing surfaces 35 interfacing with a bearing surface on the truck bolster. This orientation of the parts of the assembly is illustrated in FIG. 5, wherein like reference characters are used and the assembly 25 is shown as being bolted to the preexisting car body bearing member 36. The embodiment of FIG. 5 avoids the collection of dirt and moisture within the cage.

Various bearing surfaces ranging from low friction plastic materials such as nylon, to hardened steel, may be employed. By way of further example, in conventional trucks having no other means of control of truck hunting, it is contemplated that the bearing surfaces will be of hardened steel. In trucks having steering arms, as disclosed for example in U.S. Pat. No. 4,655,143, low friction plastic materials may be employed.

By way of example, the overall height of the side bearing assembly used on a conventional freight car truck will be about 5" with the bearing blocks projecting approximately $\frac{3}{8}$" above the surface of the cage. The overall length of the cage is approximately 17", and the spring has a 9-$\frac{5}{8}$" free height and an initial working height of 9".

Figure 6:
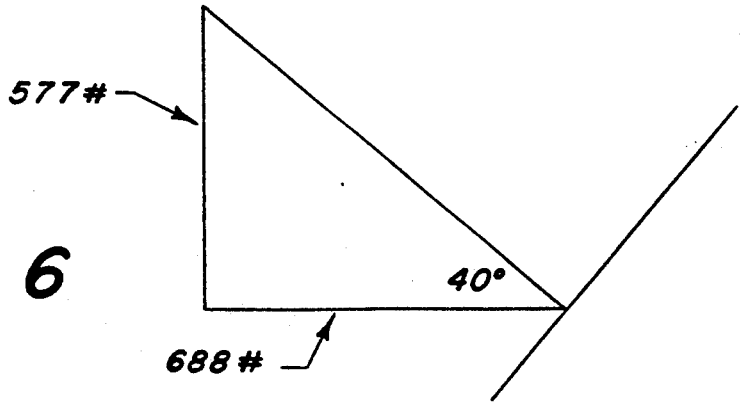
FIG. 6 is a force diagram illustrating the manner of application of bearing force through use of the present invention.

A force diagram illustrating the average vertical force on a typical bearing block in a bearing assembly formed according to the invention is illustrated in FIG. 6. As shown, the spring exerts a horizontal force against the inclined surface of 688 pounds resulting in a vertical force per bearing block of 577 pounds. With two bearing blocks, as shown in the preferred embodiment, the total average vertical force per side bearing will be 1,154 pounds.

By way of summary, since the bearing assembly is able to dissipate energy applied in a vertical direction over a prolonged assembly life span, control of car body rocking is more effectively achieved. In contrast to elastomeric springs which tend to deteriorate on account of the heat generated due to the friction forces, the control is effective throughout the life of the assembly. The added provision of elastomeric pad 30*a* functions as a relatively stiff spring acting in series with the forces of friction in a longitudinal direction and has been found to provide an even higher level of hunting control.

Still further, the features of the invention described above provide performance superior to conventional side bearings throughout a long, effective life at a relatively modest cost. The spring-loaded wedge shaped bearing blocks eliminate longitudinal clearance throughout the service life of the blocks. Long travel steel springs assures maintenance of a nearly constant normal force on the blocks at all times. The use of steel as the biasing means provides protection from the deterioration in performance caused by high temperatures associated with an inability to dissipate energy. The use of the invention allows for more effective exploitation of the potential for high speed operation available with self-steering trucks.

I claim:

1. In a railroad truck for support of a rail car body, a side bearing assembly comprising:

a bearing support mounted on the truck outboard of the car body center line, said bearing support having fore and aft inclined wall surfaces, said wall surfaces inclining upwardly and away from a centerline extending generally transversely of the bearing support;

a pair of wedge blocks seated in said bearing support, each of said wedge blocks having an inclined support surface interfacing with one of said inclined wall surfaces and an upwardly facing bearing surface;

said car body having a car body bearing member having a bearing surface in overlying relationship to said wedge blocks;

biasing means acting on said wedge blocks for biasing said interfacing inclined interfacing surfaces together;

the force of said biasing means being of a magnitude sufficient to maintain said wedge blocks in supporting engagement with the bearing surface of said car body bearing member throughout the life of said bearing means.

2. A side bearing assembly according to claim 1 wherein said biasing means comprises a coil compression spring interposed between said wedge blocks.

3. A side bearing assembly according to claim 2 wherein said spring is a long travel steel spring exerting a substantially constant force sufficient for yielding support of the car body on the wedge blocks throughout a normal range of car loading conditions.

4. A side bearing assembly according to claim 3 wherein the travel of the spring is of a length sufficient to maintain contact of the bearing surfaces throughout the bearing surface wear life.

5. A side bearing assembly according to claim 4 wherein said inclined surfaces are provided with a hardened wear liner.

6. A side bearing assembly according to claim 5 wherein the wear liner is comprised of hardened steel.

7. A side bearing assembly according to claim 6 wherein the car body bearing surface is nylon.

8. A side bearing assembly according to claim 7 further including means interconnecting the cage and said wedge blocks for limiting relative vertical movement of the wedge blocks.

9. A side bearing assembly for support of a rail car body on a rail car truck comprising:

a bearing housing displaced laterally from the car body center line, said housing having an opening and forwardly and rearwardly extended bearing support surfaces inclining from the opening towards a common housing center point located oppositely to said housing opening and a pair of generally wedge shaped bearing blocks situated within said housing opening, said blocks each having an inclined surface interfacing with one of said housing inclined surfaces, and a horizontally disposed bearing surface;

the bearing housing and the bearing blocks being interposed between supporting surfaces on the truck and the car body with the housing being mounted on one of said supporting surfaces and the bearing surfaces of said bearing blocks bearing against the other of said supporting surfaces; and biasing means interposed between said wedge shaped bearing blocks for biasing said bearing blocks in directions extending fore and aft of said car body and against said inclined surfaces, the force exerted by said biasing means being of a magnitude sufficient to maintain the bearing surfaces of the bearing blocks in supporting engagement with said other supporting surfaces.

10. A side bearing assembly according to claim 9 wherein said housing is mounted on said truck, said bearing surfaces of said bearing blocks being in supporting relationship with said car body.

11. A side bearing assembly according to claim 10 wherein said housing is mounted on said truck bolster.

12. A side bearing assembly according to claim 9 wherein said housing is mounted on said car body, said other bearing surface being located on said truck bolster.

13. A rail car side bearing assembly for support of a rail car body on a rail car truck comprising:

a bearing support disposed outboard of the car body center line, said bearing support having an inclined bearing support surface;

a wedge shaped bearing block having an inclined surface interfacing with said inclined bearing support surface and a horizontally disposed bearing surface;

the bearing support and the bearing block being interposed between supporting surfaces on the truck and the car body with the support being mounted on one of said supporting surfaces and the bearing surface of the bearing block bearing against the other supporting surface, each of said inclined surfaces inclining in directions extending lengthwise of said car body; and biasing means comprising a long travel coil compression spring having a long axis extending fore and aft of the car body for biasing said bearing block in a horizontal direction against said inclined surface, the force exerted by said biasing means maintaining the bearing surface of the bearing block in supporting engagement with said other supporting surface.

14. A side bearing assembly according to claim 13 wherein said bearing support is mounted on said truck, said bearing surface of said bearing block being in supporting relationship with said car body.

15. A side bearing assembly according to claim 14 wherein said bearing support is mounted on said truck bolster.

16. A side bearing assembly according to claim 15 further including an elastomeric pad interposed between the bearing support and the truck bolster.

17. A side bearing assembly according to claim 13 wherein said bearing support is mounted on said car body, said other bearing surface being located on said truck.

18. A side bearing assembly according to claim 17 further including an elastomeric pad interposed between the bearing support and the car body.

* * * * *